US010639779B2

(12) United States Patent
Wang et al.

(10) Patent No.: US 10,639,779 B2
(45) **Date of Patent: *May 5, 2020**

(54) MAGAZINE ASSEMBLY AND A STAPLER INCLUDING THE SAME

(71) Applicant: APEX MFG. CO., LTD., Taichung (TW)

(72) Inventors: Jing-Li Wang, Taichung (TW); Py-Yi Chang, Taichung (TW)

(73) Assignee: APEX MFG. CO., LTD., Taichung (TW)

( * ) Notice: Subject to any disclaimer, the term of this patent is extended or adjusted under 35 U.S.C. 154(b) by 282 days.

This patent is subject to a terminal disclaimer.

(21) Appl. No.: 15/668,219

(22) Filed: Aug. 3, 2017

(65) Prior Publication Data

US 2019/0039223 A1 Feb. 7, 2019

(51) Int. Cl.

| | |
|---|---|
| ***B25C 5/16*** | (2006.01) |
| ***B25C 5/11*** | (2006.01) |
| ***B25C 5/02*** | (2006.01) |
| *B27F 7/38* | (2006.01) |

(52) U.S. Cl.

CPC ..... *B25C 5/1651* (2013.01); *B25C 5/0285* (2013.01); *B25C 5/11* (2013.01); *B25C 5/161* (2013.01); *B25C 5/1696* (2013.01); *B27F 7/38* (2013.01)

(58) Field of Classification Search

CPC .. B25C 5/04; B25C 5/11; B25C 5/161; B25C 5/1686; B25C 5/00

USPC ..... 227/63.109, 120, 130, 131, 134

See application file for complete search history.

(56) References Cited

U.S. PATENT DOCUMENTS

| | | | | |
|---|---|---|---|---|
| 5,794,832 | A * | 8/1998 | Chen | B25C 5/1644 227/109 |
| 6,345,754 | B1 * | 2/2002 | Jeng | B25C 5/1651 227/109 |
| 2006/0231582 | A1 * | 10/2006 | Hong | B25C 5/1651 227/109 |
| 2011/0180583 | A1 * | 7/2011 | Wang | B25C 5/1644 227/109 |

* cited by examiner

*Primary Examiner* — Nathaniel C Chukwurah

(74) *Attorney, Agent, or Firm* — Muncy, Geissler, Olds & Lowe, P.C.

(57) ABSTRACT

A magazine assembly and a stapler including the same are provided. The magazine assembly includes a base and a rail assembly. The base has a first end portion and a second end portion. A direction from the second end portion toward the first end portion is defined as a first direction. The rail assembly is disposed on the base and adapted for a staple unit to movably abut thereagainst along the first direction. The rail assembly includes a first rail and a second rail which are separate. A first side wall of the first rail has at least one guiding portion extending in the first direction. Each guiding portion is adapted for a head of a T-shaped staple to slidably engage therewith along the first direction. The second rail is adapted for a U-shaped staple to abut thereagainst.

9 Claims, 10 Drawing Sheets

MAGAZINE ASSEMBLY AND A STAPLER INCLUDING THE SAME

BACKGROUND OF THE INVENTION

Field of the Invention

The present invention relates to a magazine assembly and a stapler including the same.

Description of the Prior Art

A stapler is an essential tool for workers in interior decoration construction and wood industry. The stapler can connect different workpieces (such as woods) together. Understandably, there a lot of processes such cutting, transport, etc. in a construction process so that it is easy to deplete a lot of efforts of the workers. Therefore, most of inventors of the conventional stapler focus on the effort-saving mechanism to hope for discharging the stapler by less efforts to save the efforts of the workers and increase a packaging efficiency.

However, inventors of the conventional stapler ignore that other structures such as configuration structures between a magazine assembly and staples also do effect a stability of discharging of stapler, and a quality of assembled products.

The present invention is, therefore, arisen to obviate or at least mitigate the above mentioned disadvantages.

SUMMARY OF THE INVENTION

The main object of the present invention is to provide a magazine assembly and a staple including the same which the design of a top of a first and second rails are located at the same horizon to applied for different staples (such as a T-shaped staple, a U-shaped staple or a reverse U-shaped staple), and each of the different staples which is assembled to the magazine assembly has a datum line in the same highest height.

To achieve the above and other objects, the magazine assembly includes a base and a rail assembly. The base has a first end portion and a second end portion, a direction from the second end portion toward the first end portion is defined as a first direction. The rail assembly is disposed on the base and adapted for a staple unit to movably abut thereagainst along the first direction. The rail assembly includes a first rail and a second rail which are separate. The staple unit includes a T-shaped staple and a U-shaped staple. Wherein a distance between a top of the first rail and a base is substantially equal to a distance between a top of the second rail and a base. Wherein the U-shaped staple defines two straight sections and a curve section, as viewed in the first direction, the two straight sections are symmetrically arranged by a center line of U-shaped staple, the curve section is divided equally by the center line, the second rail has two guiding portions, the two guiding portions are adapted for abutting against an inner wall of the U-shaped staple and being located by two sides of the center line of the second rail, each of the guiding portions has a first end point, a second end point and a successive segment, the first end point is closer to the center line than the second end point, and the first end point is farther away the base than the second end point, and the successive segment is connected with the first end point and the second end point.

To achieve the above and other objects, further includes the stapler includes a machine assembly. The machine assembly includes a pressing member, a shell and an impact plate. The shell has a magazine portion receiving the magazine assembly. The magazine assembly and the shell define a discharge opening therebetween. The discharge opening is adapted for corresponding to part of the staple unit, the pressing member and the impact plate are comovable. Wherein when the pressing member is moved relative to the shell, the pressing member drives the impact plate to move toward the discharge opening to discharge the part of the staple unit.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
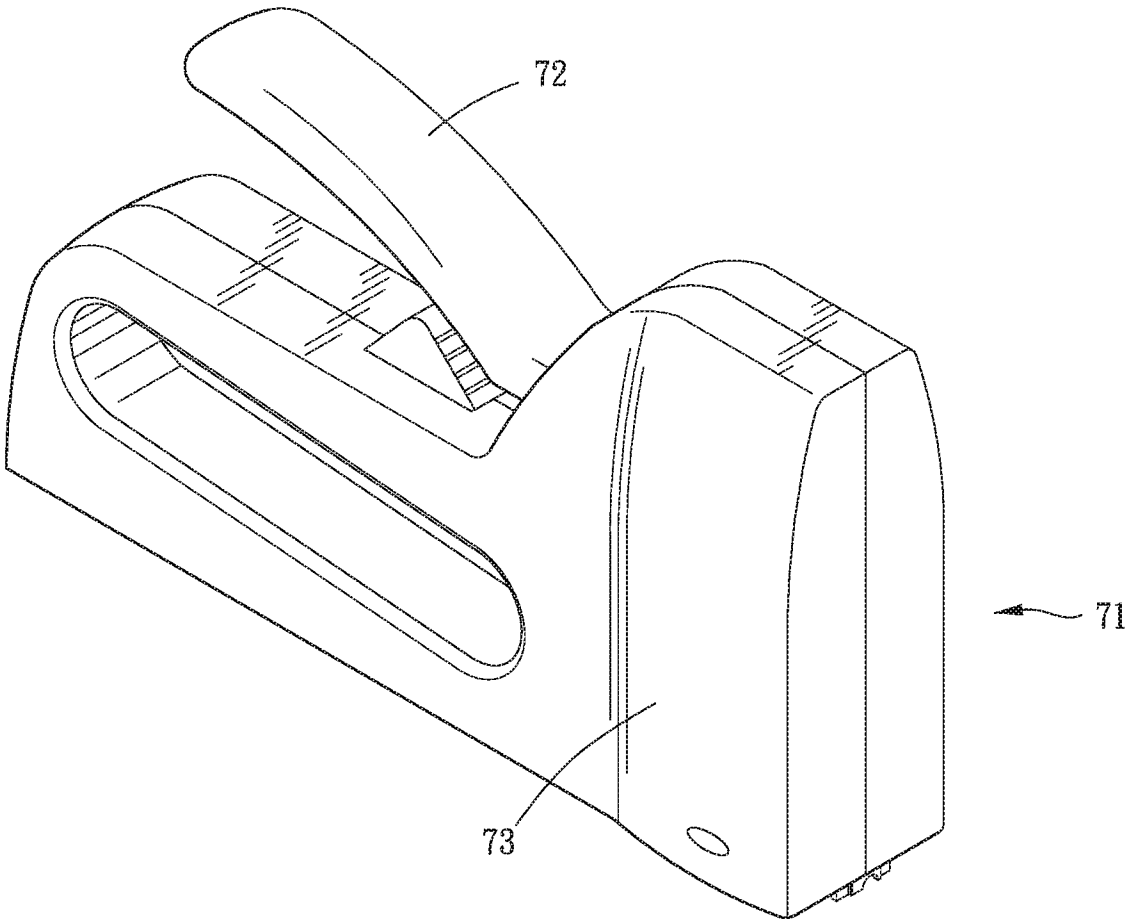
FIG. 1 is a stereogram of a preferred embodiment the present invention.
Figure 2:
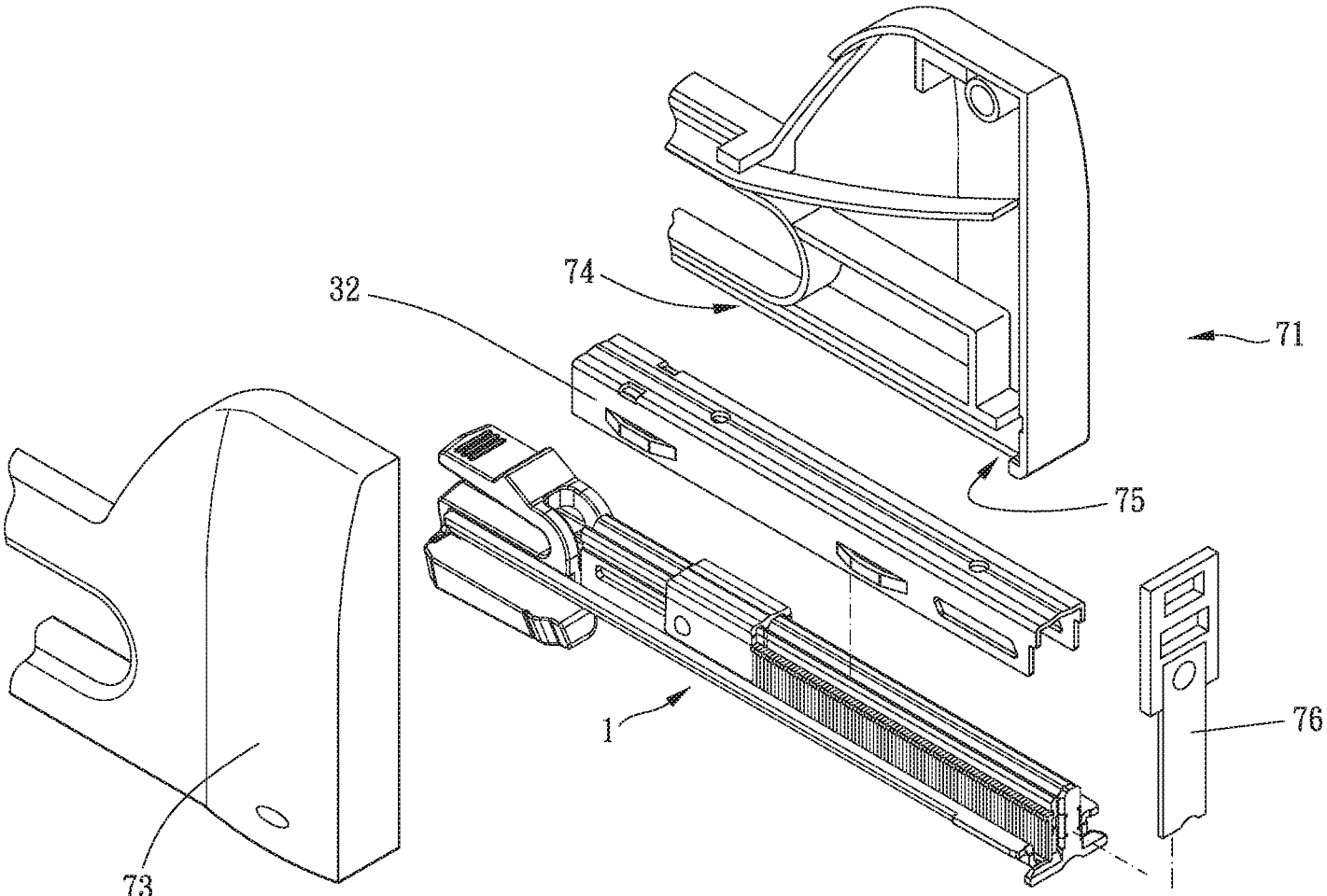
FIG. 2 is a breakdown view of the FIG. 1.
Figure 3:
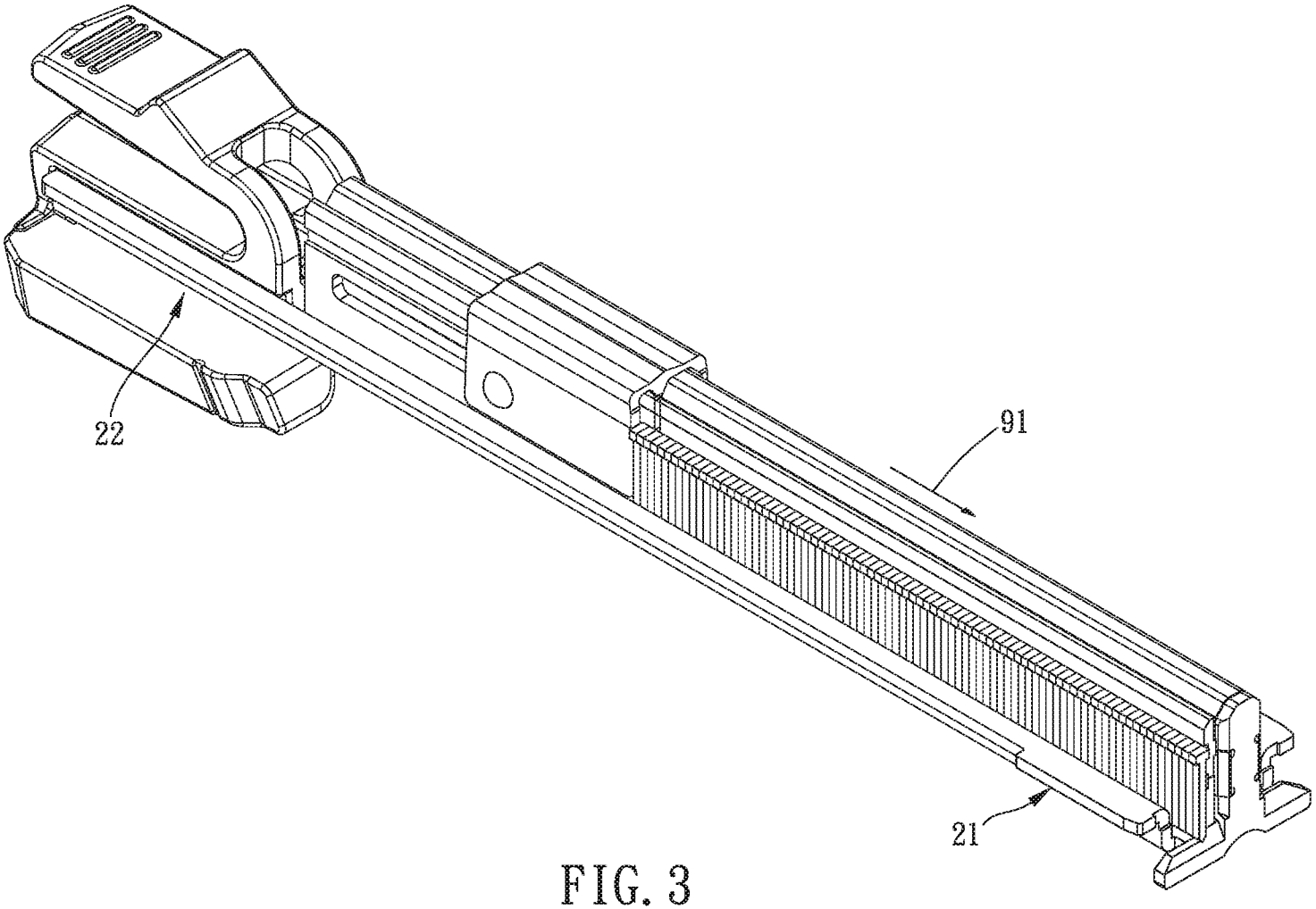
FIG. 3 is a stereogram of a magazine assembly.
Figure 4:
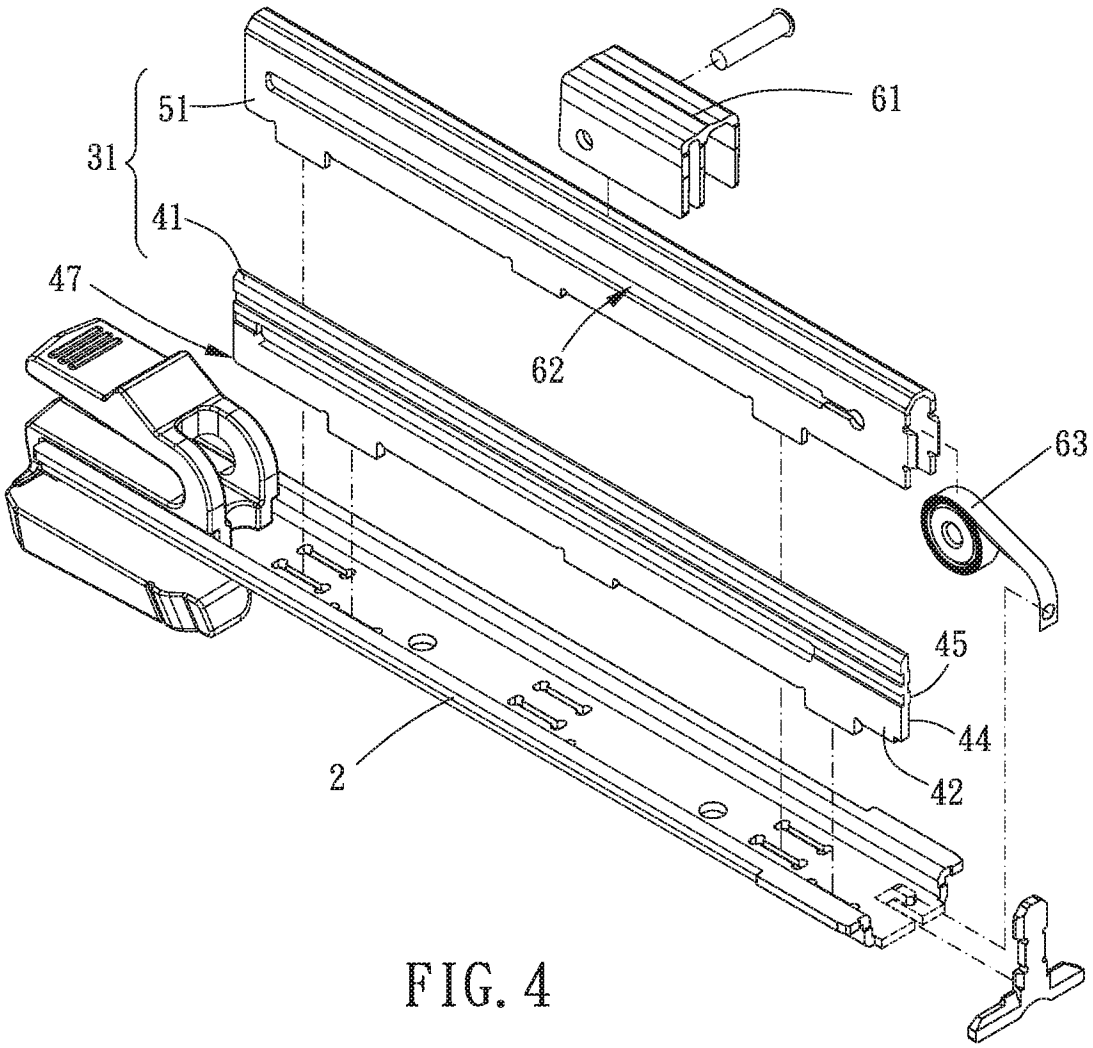
FIG. 4 is a breakdown view of the FIG. 3.
Figure 5:
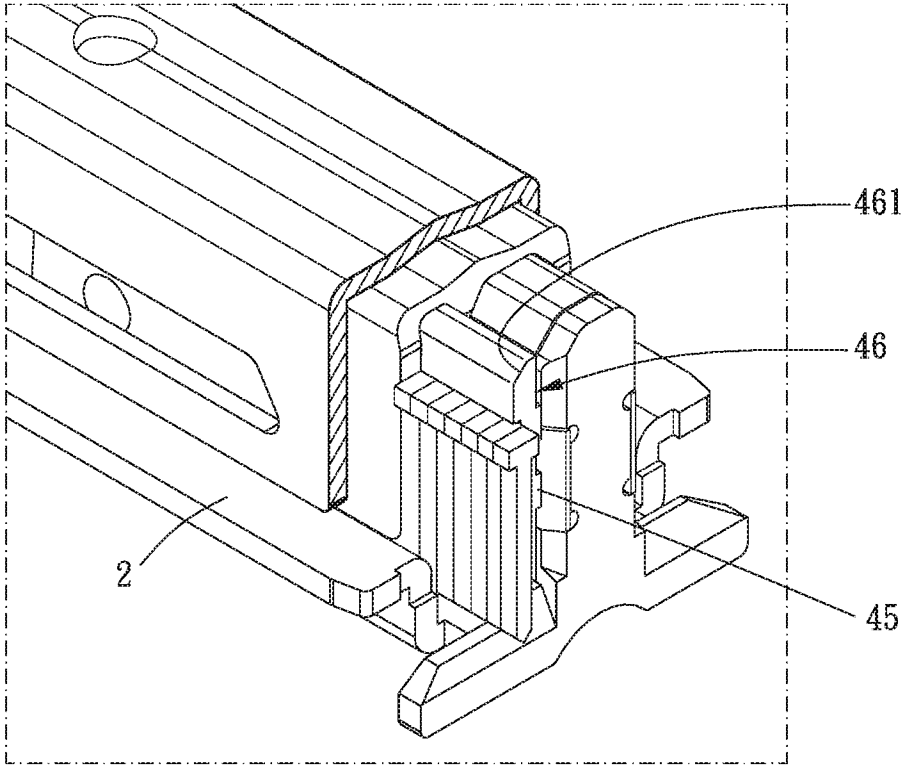
FIG. 5 to FIG. 6 are partially-enlarged views of the magazine assembly.
Figure 6:
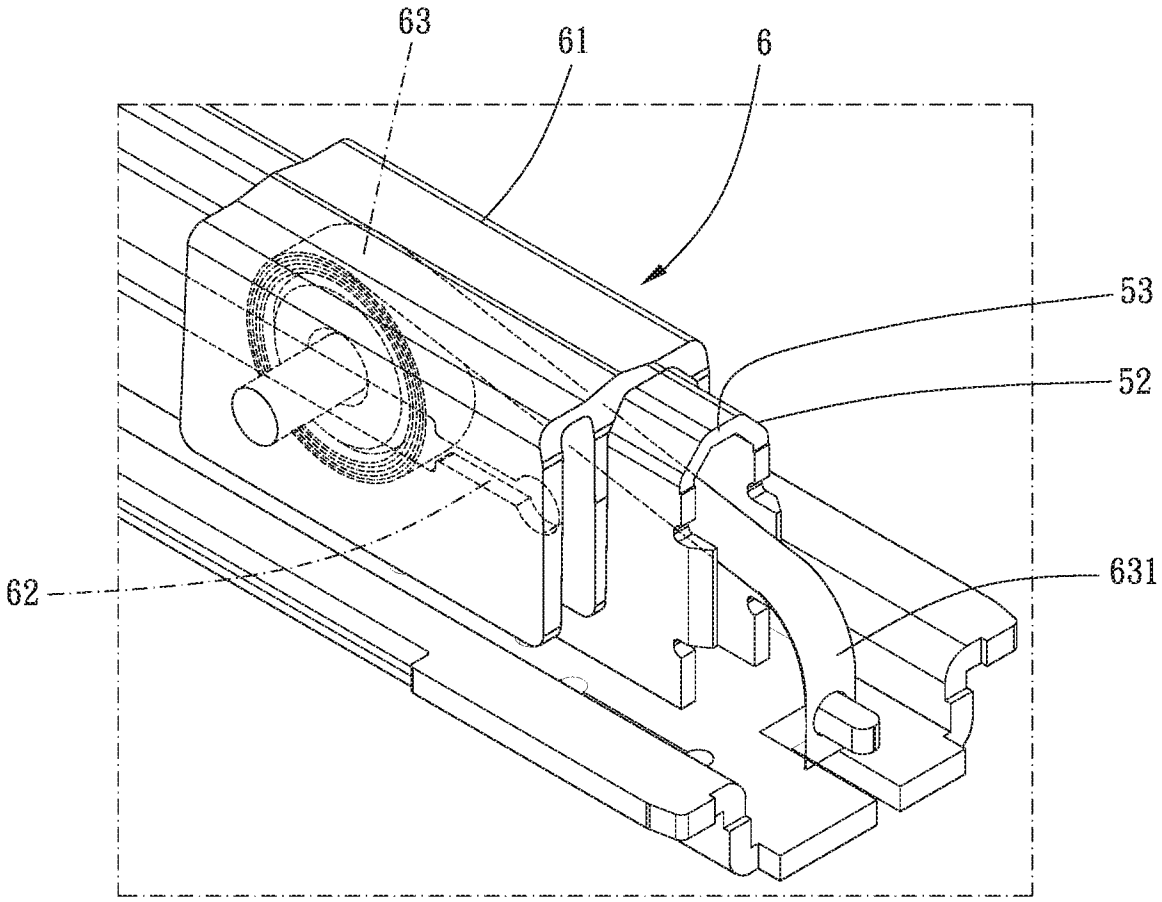
Figure 7:
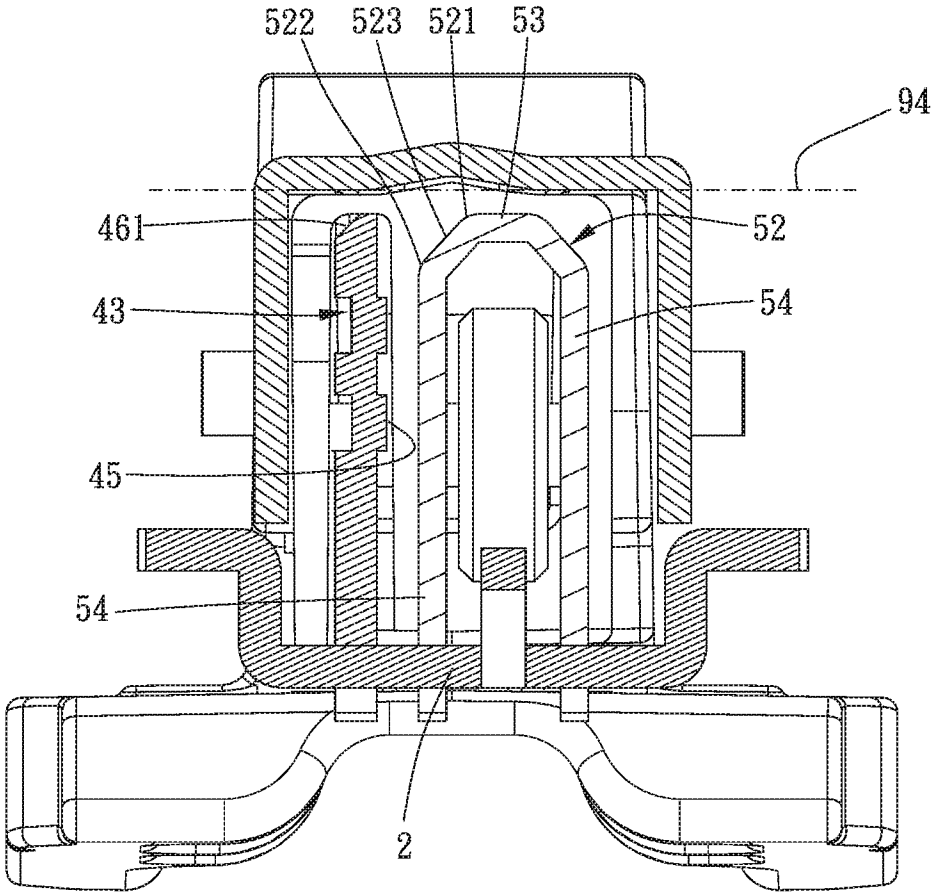
FIG. 7 to FIG. 8 are cross-sectional views of the magazine assembly.

FIG. 1 to FIG. 8 show the magazine assembly and the stapler including the same according to a first preferred embodiment of the present invention.

The stapler not only includes the magazine assembly 1, but also further includes a machine assembly 71. The machine assembly 71 includes a pressing member 72, a shell 73 and an impact plate 76. The shell 73 has a magazine portion 74 receiving the magazine assembly 1. The magazine assembly 1 and the shell 73 define a discharge opening 75 therebetween. The discharge opening 75 is adapted for corresponding to part of the staple unit. The pressing member 72 and the impact plate 76 are comovable, wherein the pressing member 72 is moved relative to the shell 73, the pressing member 72 drives the impact plate 76 to move toward the discharge opening 75 to discharge the part of the staple unit.

Specifically, the stapler is for instance a manual operation in this embodiment. The stapler is driven by an elastic plate which is connected with the pressing member 72 and the impact plate 76 through a connection mechanism, and being discharged by a rebound force formed by bending the elastic plate. However, the present invention is not limited to this type, in other embodiments the stapler also can be a pneumatic stapler or an electric stapler.

Continuously, below is the description of the magazine assembly 1. The magazine assembly 1 is configured to be assembled to a stapler. The magazine assembly 1 includes a base 2 and a rail assembly 31.

Furthermore, the base 2 has a first end portion 21 and a second end portion 22, a direction from the second end portion 22 toward the first end portion 21 being defined as a first direction 91. The rail assembly 31 is disposed on the base 2 and adapted for a staple unit to movably abut thereagainst along the first direction 91. The rail assembly 31 includes a first rail 41 and a second rail 51 which are separate, the staple unit including a T-shaped staple 81 and a U-shaped staple 82. Understandably, the rail assembly 31 is disposed on the base 2 in this embodiment, in other embodiments, the first rail 41 and the second rail 51 are made integrally which is just a simply change of the embodiment of the present invention.

Moreover, a distance between a top of the first rail 41 and the base 2 is substantially equal to a distance between a top of the second rail 51 and the base 2 so that the first and second rails 41, 51 have the co-supporting face to support a reverse U-shaped staple. Continuously, the U-shaped staple 82 defines two straight sections 83 and a curve section 84, as viewed in the first direction 91, the two straight sections 83 are symmetrically arranged by a center line 92 of the U-shaped staple 82, the curve section 84 is divided equally by the center line 92. The second rail 51 has two guiding portions 52, the two guiding portions 52 are adapted for abutting against an inner wall of the U-shaped staple 82 and being located by two sides of the center line 92 of the second rail 51. Wherein each of the guiding portions 52 has a first end point 521, a second end point 522 and a successive segment 523, the first end point 521 is closer to the center line 92 than the second end point 522, and the first end point 521 is farther away the base 2 than the second end point 522, the successive segment 523 is connected with the first end point 521 and the second end point 522.

In this embodiment, the first and the second end points 521, 522 are adapted for abutting against an inner wall of the curve section 84, and the successive segment 523 does not contact the inner wall of the curve section 84 so as to reduce the contact area and further reduce the friction therebetween. As viewed in whole, the second rail 51 is connected with the U-shaped staple 82 by connection points, thus the U-shaped staple 82 is slidable relative to the second rail 51 smoothly, and the height of the U-shaped staple 82 can be controlled precisely (a distance between the highest point of the U-shaped staple 82 and the base 2). For example, a height position of the U-shapes staple 82 may equal to a height position of the T-shaped staple 81 which is disposed on the first rail 41 so as to let the staples has the same highest level when the staple unit is assembled to the rail assembly 31.

Specifically, the magazine assembly 1 further includes a cover 32 covering the rail assembly 31, and the cover 32 has a top plate 33 and two side plates 34. The rail assembly 31 is between the top plate 33 and the base 2. As viewed in the first direction 91, the top plate 33 has a raised portion 331 and two smooth sections 332 connected with two sides of the raised portion 331. Because of the staple unit disposed in the rail assembly 31 has the same highest height standard, thus the two smooth sections 332 can be located in a same plane 94. Therefore, the whole of the cover 32 does not have significant different heights in the direction of the center line 92. Wherein, the raised portion 331 protrudes away from the rail assembly 31 so that a roof-shaped staple can be assembled to the magazine assembly 1.

Preferably, as viewed in the first direction 91, the two guiding portions 52 are symmetrically arranged and slant relative to the center line 92, and the symmetrical design of two guiding portions 52 is adapted for supporting stably the curve section 84 so as to discharge stably. Wherein, the successive segment 523 is preferred an inclined face 461, thus it is not only for producing easily, but also can easy control a relative position of the first and second end points 521, 522.

Figure 9:
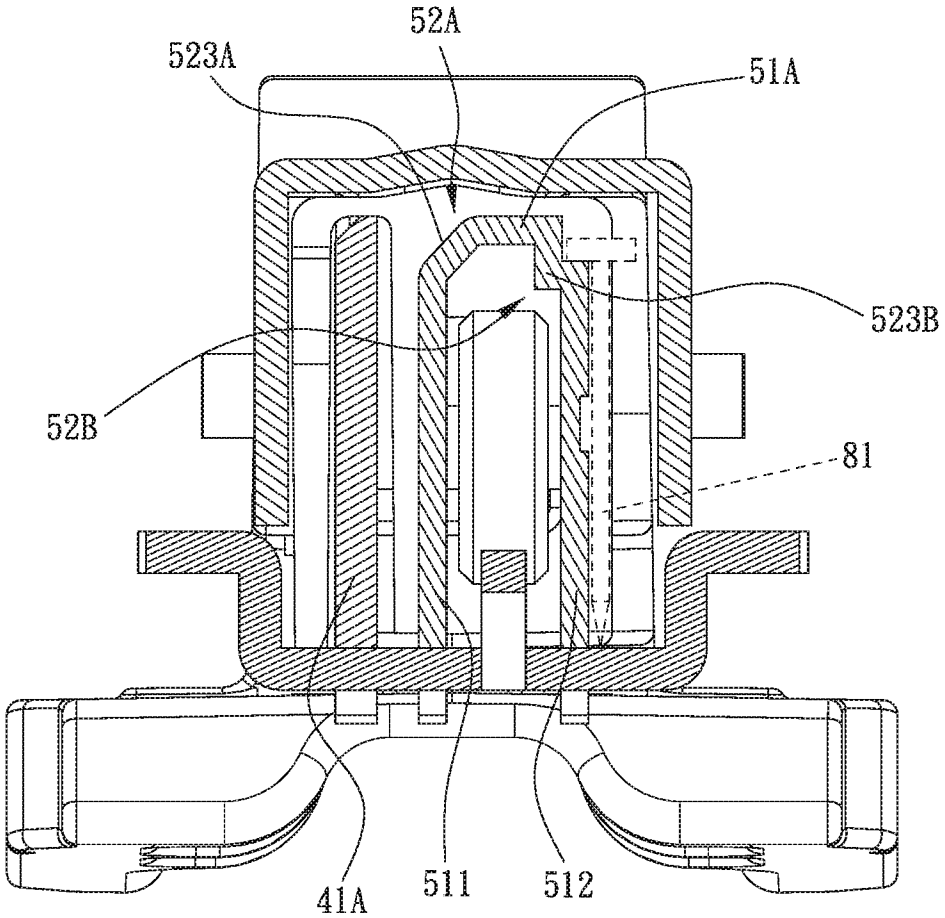
FIG. 9 is a cross-sectional view of the magazine assembly of another preferred embodiment of the present invention.

However, the present invention is not limited to the embodiment above. The present invention can also provide the embodiment such as shown in FIG. 9. As viewed in the first direction 91, the successive segment 523A of one of the two guiding portions 52A is an inclined face 461 and approximates to the first rail 41A, and the successive segment 523B of the other of two guiding portions 52B is stepped and away from the first rail 41A. Wherein, the guiding portions 523B which is stepped are adapted for the head of the T-shaped staple 81 abutting thereagainst. That is, the T-shaped staple 81 can abut against in two positions (the first rail 41A and the successive segment 523B).

In this embodiment, a first wall 511 of second rail 51A is connected with the guiding portion 52A, a second wall 512 of second rail 51A is connected with another guiding portion 52B. Understandably, a side of the first rail 41A which is away from the second rail 51A is adapted for being abutted against by the reverse U-shaped staple or the roof-shaped staple. A side of the first rail 41A which is facing the second rail 51A and the first wall 511 are adapted for being abutted against by the U-shaped staple 82, the second wall 512 is adapted for being abutted against laterally by the T-shaped staple 81, the U-shaped staple 82, the reverse U-shaped staple and the roof-shaped staple. Besides, in other embodiments, the successive segment 523 can be arc convex shaped, arc concave shaped, saw tooth-shaped, or other geometric shaped etc.

Figure 10:
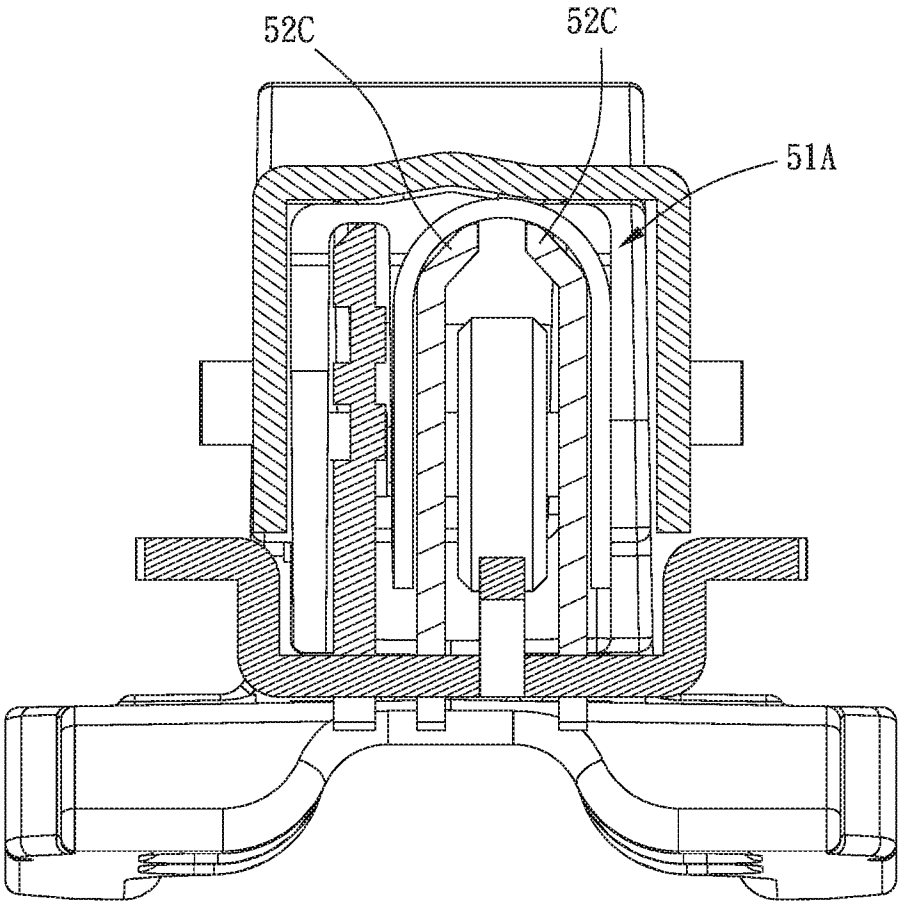
FIG. 10 is a cross-sectional view of the magazine assembly of the other preferred embodiment of the present invention.

Preferably, the second rail further has a connection portion 53 connected with the two guiding portions 52, the connection portion 53 can further improve a stability and strength of the two guiding portions 52 so as to prolong a lifespan. Wherein, the connection portion 53 is between a phantom line and the base 2, and the phantom line is between the first end points 521 of the two guiding portions 52 so as to ensure not to effect the highest position of the U-shaped staple 82. That is, the connection portion 53 does not contact the curve section 84. Of course, depends on cases, the present invention can also as shown in FIG. 10 which is disclosed a second rail 51A of the other embodiment, the second rail 51A is only disposed two guiding portions 52C. And when one of the guiding portions 52C is broken, it can only exchange the broken part of the guiding portions 52C instead of exchanging all of the guiding portions 52C.

Figure 8:
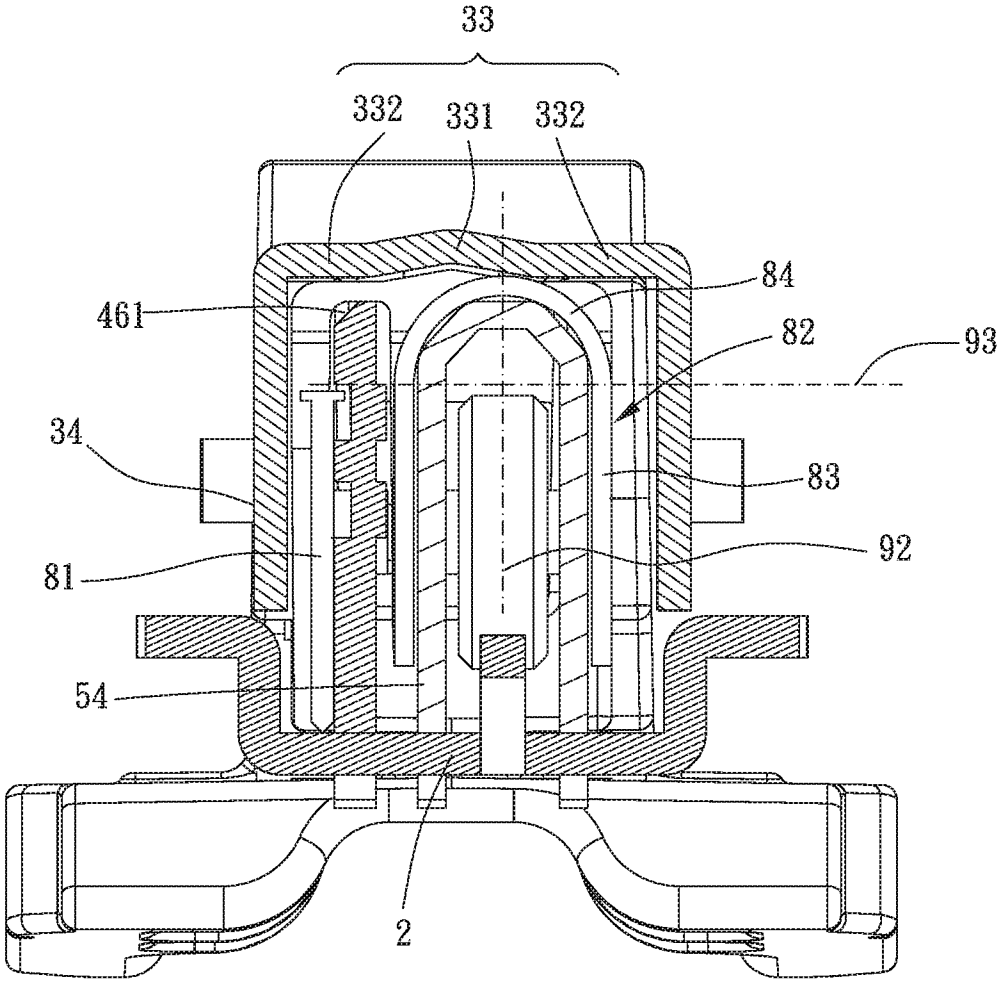

Please refer to FIG. 1 to FIG. 8 again. The description of the relationship between the second rail 51 and the U-shaped staple 82 is below. As viewed in the first direction 91, the U-shaped staple 82 defines a datum line 93 passing through two joins of the two straight sections 83 and the curve section 84, and the two guiding portions 52 and the connection portion 53 locate between the datum line 93 and the curve section 84 (as shown in FIG. 8). And the connection portion 53 is connected with the two guiding portions 52 along a direction in which the phantom line extends, the connection portion 53 and the two guiding portions 52 are configured to be a part of a trapezoid. Wherein, a length of the connection portion 53 is equal to a length of each of the guiding portions 52. Specifically, the second rail 51 further includes two main bodies 54 which are separate. Each of the two main bodies 54 is connected with one of the two guiding portions 52 and the base 2. A join of the base 2 and one of the two guiding portions 52 is a rounded corner and defined as the second end point 522. Each join of the guiding portions 52 and the connection portion 53 is a rounded corner and defined as the first end point 521. Wherein, the first and second end points 521, 522 which are as the round corners are matching to the curve section 84 so that the U-shaped staple 82 can be moved slidably easily, and also can reduce the guiding portions 52 and the curve section 84 being broken by the friction.

In this embodiment, the first rail 41 has at least one groove portion 43 extending along the first direction 91 is disposed on a first side wall 42 facing in a direction away from the second rail 51. The at least one groove portion 43 is adapted for a head of the T-shaped staple 81 to slidably engage therewith along the first direction 91, and assembling a variety of T-shaped staple s 81 with different lengths (the features can also apply to the second wall 512 as shown in FIG. 9). Preferably, the first rail 41 further has a second side wall 44 facing the second rail 51, the second side wall 44 has at least one rib portion 45 extending along the first direction 91, the at least one rib portion 45 corresponds to the at least one groove portion 43 so as to enhance a strength of the first rail 41. And the at least one rib portion 45 protrudes toward the second rail 51 for being abutted against laterally by the U-shaped staple 82 so as to increase the stability of the U-shaped staple 82.

Understandably, the first rail 41 further includes a top portion 46 and a bottom portion 47 which are connected with the first side wall 42 and the second side wall 44, the bottom portion 47 is connected with the base 2. The top portion 46 has an inclined face 461, the inclined face 461 extends slantly from the second side wall 44 toward the first side wall 42 and the base 2, and the inclined face 461 is for being abutted against by the head of the T-shaped staple 81. Thus, the inclined face 461 which has contact portions of different heights relative to the base can abut T-shaped staples 81 of different lengths. Therefore, the T-shaped staple 81 can abut against exactly the inclined face 461.

Moreover, the magazine assembly 1 further includes a pushing mechanism 6. The pushing mechanism 6 has a pushing member 61, two slide tracks 62, and at least one constant torque spring 63 which rolls back normally. The pushing member 61 covers the rail assembly 31. The two slide tracks 62 respectively penetrate the first and second rails 41, 51. The constant torque spring 63 is rollably attached to the pushing member 61, and a free end 631 of the constant torque spring 63 is positioned at the first end portion 21 so as to normally bias the pushing member 61 to move toward the first end portion 21. The constant torque spring 63 can bias the pushing member 61 to normally push the staple unit stably so as to prevent the staple unit from swaying and to be kept in a stable state until the staple is discharged. Thereby, the present invention has a preferred quality of discharge and a preferred location of the staple unit after discharging. In this embodiment, the second rail 51 covers the constant torque spring 63 so that when there is an unexpected impact, the constant torque spring 63 will not separate by an impact force.

Given the above, the magazine assembly and the stapler including the same of the present invention, the magazine assembly has the first and second rails. The height of the first rail and the height of the second rail are in the same horizon, and the design of the guiding portions can let the height of the U-shaped staple which is disposed on the second rail and the height of the T-shaped staple which is disposed on the first rail are in the same height. Thus, the cover can cover the rail assembly flatly to be adapted for assembling different types of staples (such as the T-shaped, U-shaped, reverse U-shaped and roof-shaped staples) so that it is convenient to use.

While we have shown and described various embodiments in accordance with the present invention, it should be clear to those skilled in the art that further embodiments may be made without departing from the scope of the present invention.

What is claimed is:

1. A magazine assembly, configured to be assembled to a stapler, including:

a base, having a first end portion and a second end portion, a direction from the second end portion toward the first end portion being defined as a first direction;

a rail assembly, disposed on the base and adapted for a staple unit to movably abut thereagainst along the first direction, including a first rail and a second rail which are separate, the staple unit including a T-shaped staple and a U-shaped staple;

wherein a distance between a top of the first rail and the base is substantially equal to a distance between a top of the second rail and the base; and wherein the U-shaped staple defines two straight sections and a curve section, as viewed in the first direction, the two straight sections are symmetrically arranged by a center line of U-shaped staple, the curve section is divided equally by the center line, the second rail has two guiding portions, the two guiding portions are adapted for abutting against an inner wall of the U-shaped staple and being located by two sides of the center line of the second rail, each of the guiding portions has a first end point, a second end point and a successive segment, the first end point is closer to the center line than the second end point, and the first end point is farther away the base than the second end point, and the successive segment is connected with the first end point and the second end point;

wherein the first and the second end points are adapted for abutting against an inner wall of the curve section, and the successive segment does not contact the inner wall of the curve section.

2. The magazine assembly of claim 1, wherein the first rail has at least one groove portion extending along the first direction is disposed on a first side wall facing in a direction away from the second rail, the at least one groove portion is adapted for a head of the T-shaped staple to slidably engage therewith along the first direction.

3. The magazine assembly of claim 2, wherein the first rail further has a second side wall facing the second rail, the second side wall has at least one rib portion extending along the first direction, the at least one rib portion corresponds to the at least one groove portion, and the at least one rib portion protrudes toward the second rail for being abutted against laterally by the U-shaped staple.

4. The magazine assembly of claim 1, wherein as viewed in the first direction, the two guiding portions are symmetrically arranged and slant relative to the center line, and the successive segment is an inclined face.

5. The magazine assembly of claim 4, wherein the second rail further has a connection portion connected with the two guiding portions, the connection portion is between a phantom line and the base, and the phantom line is between the first end points of the two guiding portions.

6. The magazine assembly of claim 5, wherein as viewed in the first direction, the U-shaped staple defines a datum line passing through two joins of the two straight sections and the curve section, and the two guiding portions and the connection portion are located between the datum line and the curve section.

7. The magazine assembly of claim 6, wherein the connection portion is connected with the two guiding portions along a direction in which the phantom line extends, the connection portion and the two guiding portions are configured to be a part of a trapezoid; the first rail has at least one groove portion extending along the first direction is disposed on a first side wall facing in a direction away from the second rail, the at least one groove portion is adapted for a head of the T-shaped staple to slidably engage therewith along the first direction; the first rail further has a second side wall facing the second rail, the second side wall has at least one rib portion extending along the first direction, the at least one rib portion corresponds to the at least one groove portion, and the at least one rib portion protrudes toward the second rail for being abutted against laterally by the U-shaped staple; the second rail further includes two main bodies which are separate, each of the two main bodies is connected with one of the two guiding portions and the base, a join of the base and one of the two guiding portions is a rounded corner and defined as the second end point, each join of the guiding portions and the connection portion is a rounded corner and defined as the first end point; the first rail further includes a top portion and a bottom portion which are connected with the first side wall and the second side wall, the bottom portion is connected with the base, the top portion has an inclined face, the inclined face extends slantly from the second side wall toward the first side wall and the base, and the inclined face is for being abutted against by the head of the T-shaped staple; the magazine assembly further includes a pushing mechanism, the pushing mechanism has a pushing member, two slide tracks, and at least one constant torque spring which rolls back normally, the pushing member covers the rail assembly, the two slide tracks respectively penetrate the first and second rails, the constant torque spring is rollably attached to the pushing member, and a free end of the constant torque spring is positioned at the first end portion so as to normally bias the pushing member to move toward the first end portion; the second rail covers the constant torque spring; the magazine assembly further includes a cover covering the rail assembly, the cover has a top plate and two side plates, the rail assembly is between the top plate and the base, as viewed in the first direction, the top plate has a raised portion and two smooth sections connected with two sides of the raised portion, the two smooth sections are located in a same plane, the raised portion protrudes away from the rail assembly.

8. A stapler including the magazine assembly of claim 1, further including:

a machine assembly, including a pressing member, a shell and an impact plate, the shell having a magazine portion receiving the magazine assembly, the magazine assembly and the shell defining a discharge opening therebetween, the discharge opening being adapted for corresponding to part of the staple unit, the pressing member and the impact plate being comovable, wherein when the pressing member is moved relative to the shell, the pressing member drives the impact plate to move toward the discharge opening to discharge the part of the staple unit.

9. A magazine assembly, configured to be assembled to a stapler, including:

a base, having a first end portion and a second end portion, a direction from the second end portion toward the first end portion being defined as a first direction;

a rail assembly, disposed on the base and adapted for a staple unit to movably abut thereagainst along the first direction, including a first rail and a second rail which are separate, the staple unit including a T-shaped staple and a U-shaped staple;

wherein a distance between a top of the first rail and the base is substantially equal to a distance between a top of the second rail and the base;

wherein the U-shaped staple defines two straight sections and a curve section, as viewed in the first direction, the two straight sections are symmetrically arranged by a center line of U-shaped staple, the curve section is divided equally by the center line, the second rail has two guiding portions, the two guiding portions are adapted for abutting against an inner wall of the U-shaped staple and being located by two sides of the center line of the second rail, each of the guiding portions has a first end point, a second end point and a successive segment, the first end point is closer to the center line than the second end point, and the first end point is farther away the base than the second end point, and the successive segment is connected with the first end point and the second end point;

wherein as viewed in the first direction, the successive segment of one of the two guiding portions is an inclined face and approximates to the first rail, and the successive segment of the other of the two guiding portions is stepped and away from the first rail.

* * * * *